US011298905B2

(12) United States Patent
Burstrom et al.

(10) Patent No.: US 11,298,905 B2
(45) Date of Patent: Apr. 12, 2022

(54) PRESSING ARRANGEMENT

(71) Applicant: Quintus Technologies AB, Vasteras (SE)

(72) Inventors: Per Burstrom, Vasteras (SE); Magnus Byggnevi, Vasteras (SE); Stefan Gustafsson, Vasteras (SE)

(73) Assignee: QUINTUS TECHNOLOGIES AB, Vasteras (SE)

( * ) Notice: Subject to any disclaimer, the term of this patent is extended or adjusted under 35 U.S.C. 154(b) by 49 days.

(21) Appl. No.: 16/495,297

(22) PCT Filed: Mar. 23, 2017

(86) PCT No.: PCT/EP2017/056986
§ 371 (c)(1),
(2) Date: Sep. 18, 2019

(87) PCT Pub. No.: WO2018/171884
PCT Pub. Date: Sep. 27, 2018

(65) Prior Publication Data

US 2020/0094508 A1 Mar. 26, 2020

(51) Int. Cl.
*F27D 7/06* (2006.01)
*B30B 11/00* (2006.01)

(52) U.S. Cl.
CPC ..... *B30B 11/002* (2013.01)

(58) Field of Classification Search
CPC ..... B30B 11/002; B30B 11/001; B30B 15/34; B22F 3/15; B22F 2003/153; F27B 17/0083
(Continued)

(56) References Cited

U.S. PATENT DOCUMENTS 5,118,289 A 6/1992 Bergman et al.
5,123,832 A * 6/1992 Bergman ..... B01J 3/04 219/400
(Continued)

FOREIGN PATENT DOCUMENTS

CN 102368482 A 3/2012
CN 105121145 A 12/2015
(Continued)

OTHER PUBLICATIONS

Russian Office Action and English translation thereof dated May 28, 2020.
(Continued)

*Primary Examiner* — Vivek K Shirsat
*Assistant Examiner* — Ko-Wei Lin
(74) *Attorney, Agent, or Firm* — Harness, Dickey & Pierce, P.L.C.

(57) ABSTRACT

A pressing arrangement (100) is disclosed. The pressing arrangement (100) comprises a pressure vessel (2) and a furnace chamber (18) arranged within the pressure vessel (2). The furnace chamber (18) is at least partly enclosed by a heat insulated casing (6, 5 7, 8) and arranged so that pressure medium can enter and exit the furnace chamber (18). The pressing arrangement (100) comprises a plurality of pressure medium guiding passages (10, 11) in fluid communication with the furnace chamber (18) and arranged to form an outer cooling loop within the pressure vessel (2). The pressing arrangement (100) comprises a heat absorbing element (20) which is arranged within the pressure vessel (2) and which is 10 configured to absorb heat from pressure medium having exited the furnace chamber (18).

13 Claims, 3 Drawing Sheets

(58) Field of Classification Search
USPC ..... 425/405.2, 405.1; 432/205
See application file for complete search history.

(56) References Cited

U.S. PATENT DOCUMENTS

| | | | | | |
|---|---|---|---|---|---|
| 5,251,880 | A * | 10/1993 | Ishii | B30B 11/002 | 266/252 |
| 6,250,907 | B1 * | 6/2001 | Bergman | B22F 3/15 | 219/400 |
| 6,331,271 | B1 | 12/2001 | Bergman | | |
| 6,514,066 | B1 * | 2/2003 | Bergman | B30B 11/002 | 425/405.2 |
| 7,008,210 | B2 * | 3/2006 | Manabe | F27D 7/04 | 425/185 |
| 7,011,510 | B2 * | 3/2006 | Nakai | B22F 3/15 | 219/400 |
| 8,449,279 | B2 * | 5/2013 | Nakai | B30B 15/34 | 425/78 |
| 8,647,092 | B2 * | 2/2014 | Nakai | B30B 11/002 | 425/78 |
| 2003/0197295 | A1 * | 10/2003 | Nakai | B29C 43/10 | 264/40.3 |
| 2006/0201221 | A1 * | 9/2006 | Sehlstedt | B30B 11/001 | 72/201 |
| 2011/0008741 | A1 * | 1/2011 | Gardin | B22F 3/003 | 432/19 |
| 2011/0283901 | A1 * | 11/2011 | Graf | F27B 5/04 | 100/102 |
| 2011/0285062 | A1 * | 11/2011 | Graf | B22F 3/15 | 264/517 |
| 2013/0071508 | A1 * | 3/2013 | Nakai | B30B 11/002 | 425/405.2 |
| 2013/0337395 | A1 * | 12/2013 | Gardin | B30B 11/002 | 432/205 |
| 2013/0344451 | A1 * | 12/2013 | Gardin | B30B 11/002 | 432/29 |
| 2014/0127637 | A1 * | 5/2014 | Gardin | B22F 3/003 | 432/201 |
| 2014/0272745 | A1 * | 9/2014 | Gardin | F27D 7/04 | 432/24 |
| 2015/0079528 | A1 * | 3/2015 | Gardin | B30B 11/002 | 432/24 |

FOREIGN PATENT DOCUMENTS

| | | | | | |
|---|---|---|---|---|---|
| CN | 205341924 | U | | 6/2016 | |
| DE | 3833337 | A1 | | 4/1990 | |
| EP | 0438083 | A1 | | 7/1991 | |
| EP | 0502704 | A1 | | 9/1992 | |
| FR | 2672669 | A1 | | 8/1992 | |
| JP | S5987032 | A | | 5/1984 | |
| JP | H04080592 | A | | 3/1992 | |
| JP | H04240389 | A | | 8/1992 | |
| JP | H04260783 | A | | 9/1992 | |
| JP | H04263787 | A | | 9/1992 | |
| JP | H0611268 | A | | 1/1994 | |
| JP | 06025711 | A | * | 2/1994 | B30B 11/002 |
| JP | H0625711 | A | | 2/1994 | |
| JP | 2001339022 | A | | 12/2001 | |
| JP | 2004221605 | A | | 8/2004 | |
| JP | 2014-507281 | A | | 3/2014 | |
| RU | 2302924 | C2 | | 7/2007 | |
| RU | 2455112 | C2 | | 7/2012 | |
| WO | WO-03070402 | A1 | | 8/2003 | |
| WO | WO-2009076973 | A1 | | 6/2009 | |
| WO | WO-2009/154089 | A1 | | 12/2009 | |
| WO | WO-2012/092959 | A1 | | 7/2012 | |
| WO | WO-2014/139936 | A1 | | 9/2014 | |
| WO | WO-2015/005047 | A1 | | 1/2015 | |

OTHER PUBLICATIONS

International Search Report PCT/ISA/220 for International Application No. PCT/EP2017/056986 dated Dec. 11, 2017.

Written Opinion of the International Searching Authority PCT/ISA/237 for International Application No. PCT/EP2017/056986 dated Dec. 11, 2017.

International Preliminary Report of Patentability PCT/IPEA/416 for International Application No. PCT/EP2017/056986 dated Jul. 8, 2019.

Written Opinion of the International Preliminary Report of Patentability PCT/IPEA/408 for International Application No. PCT/EP2017/056986 dated Feb. 20, 2019.

Office Action for Chinese Patent Application No. 201780088866.4 dated Nov. 26, 2020.

Office Action for Japanese Patent Application No. 2019-551465 dated Jan. 12, 2021 and English translation thereof.

* cited by examiner

PRESSING ARRANGEMENT

TECHNICAL FIELD

The present invention generally relates to the field of pressure treatment. In particular, the present invention relates to a pressing arrangement for treatment of at least one article by means of hot pressing, such as, for example, hot isostatic pressing (HIP).

BACKGROUND

Hot isostatic pressing (HIP) may for example be used for reducing or even eliminating porosity in castings (e.g., turbine blades) in order to substantially increase their service life and strength (e.g., their fatigue strength). HIP may in addition be used in manufacturing of products by means of compressing powder, which products are desired or required to be fully, or substantially fully, dense, and to have pore-free, or substantially pore-free, outer surfaces, etc.

An article to be subjected to pressure treatment by HIP may be positioned in a load compartment or chamber of a thermally insulated pressure vessel. A treatment cycle may comprise loading the article, treating the article, and unloading the article. Several articles may be treated simultaneously. The treatment cycle may be divided into several parts, or phases, such as a pressing phase, a heating phase, and a cooling phase. After loading an article into the pressure vessel, it may then be sealed, followed by introduction of a pressure medium (e.g., comprising an inert gas such as Argon-containing gas) into the pressure vessel and the load compartment thereof. The pressure and temperature of the pressure medium is then increased, such that the article is subjected to an increased pressure and an increased temperature during a selected period of time. The increase in temperature of the pressure medium, which in turn may cause an increase in temperature of the article, is provided by means of a heating element or furnace arranged in a furnace chamber of the pressure vessel. The pressures, temperatures and treatment times may for example depend on the desired or required material properties of the treated article, the particular field of application, and the required quality of the treated article. Pressures in HIP may for example be in the range from 200 bar to 5000 bar, such as from 800 bar to 2000 bar. Temperatures in HIP may for example be in the range from 300° C. to 3000° C., such as from 800° C. to 2000° C.

When the pressure treatment of the article is finished, the article may need to be cooled before being removed, or unloaded, from the pressure vessel. Characteristics of the cooling—for example the rate thereof—of the article may affect the metallurgical properties of the treated article. It is generally desired to be able to cool an article in a homogeneous manner, and also, if possible, to be able to control the cooling rate. Efforts have been made to reduce the period of time required for cooling of an article subjected to HIP. For example, during cooling phase, it may be required or desired to decrease the temperature of the pressure medium (and thereby of the article) rapidly without causing any large temperature variations within the load compartment (e.g., so that the temperature within the load compartment is reduced in a uniform manner) in a controlled manner, and to maintain the temperature at a certain temperature level or within a certain temperature range during a selected period of time with no or only small fluctuations in temperature during the selected period of time. By not having any large temperature variations within the load compartment during cooling of an article, there may be no or only very small temperature variations within different portions of the article during the cooling thereof. Thereby, internal stresses in the treated article may be reduced.

SUMMARY

It is contemplated that the cooling of the article may be carried out while the article is subjected to a relatively high pressure, which may be beneficial for the metallurgical properties of the treated article.

In view of this and the description in the foregoing background section, a concern of the present invention is to provide a pressing arrangement capable of carrying out pressure treatment of at least one article for example by means of HIP, which pressing arrangement is capable of providing a relatively rapid cooling of the at least one article subjected to pressure treatment to a required or desired temperature during a cooling phase of a treatment cycle.

A further concern of the present invention is to provide a pressing arrangement capable of carrying out pressure treatment of at least one article for example by means of HIP, which pressing arrangement is capable of providing a relatively high rate of cooling of the at least one article subjected to pressure treatment during a cooling phase of a treatment cycle, possibly with a rate of cooling of the pressure medium exceeding 300° C. per minute.

To address at least one of these concerns and other concerns, a pressing arrangement in accordance with the independent claim is provided. Preferred embodiments are defined by the dependent claims.

According to a first aspect there is provided a pressing arrangement. The pressing arrangement may be suitable for treatment of at least one article by means of pressing, for example hot pressing such as HIP. The pressing arrangement comprises a pressure vessel. The pressure vessel comprises a pressure cylinder and an end closure. The pressing arrangement comprises a furnace chamber that is arranged within the pressure vessel. The furnace chamber may be arranged or configured to hold at least one article. The furnace chamber is at least partly enclosed by a heat insulated casing. The furnace chamber (e.g., the heat insulated casing thereof) may be arranged so that pressure medium can enter and exit the furnace chamber. The pressing arrangement comprises a plurality of pressure medium guiding passages in fluid communication with the furnace chamber and arranged to form an outer cooling loop within the pressure vessel. The pressing arrangement comprises a heat absorbing element. The heat absorbing element is arranged within the pressure vessel, and is configured to absorb heat, or thermal energy, from the pressure medium.

The heat insulated casing of the pressing arrangement comprises a heat insulating portion and a housing at least partly enclosing the heat insulating portion.

A part of the outer cooling loop comprises at least one first pressure medium guiding passage formed between at least portions of the housing and the heat insulating portion, respectively, and arranged to guide the pressure medium after having exited the furnace chamber towards the end closure to a space, which is between the end closure and the furnace chamber, and in which space the heat absorbing element is arranged.

The heat absorbing element comprises at least one inlet permitting the pressure medium having exited the furnace chamber to enter into an interior of the heat absorbing element. The heat absorbing element is configured so as to permit pressure medium to be guided through the heat absorbing element towards at least one outlet of the heat absorbing element, which at least one outlet permits the pressure medium to exit the heat absorbing element. The at least one inlet is arranged on a first side of the heat absorbing element and the at least one outlet is arranged on a second side of the heat absorbing element. The second side of the heat absorbing element is facing in a direction towards an inner surface of the end closure.

Another part of the outer cooling loop comprises at least one second pressure medium guiding passage arranged to guide the pressure medium having exited the heat absorbing element (via the at least one second opening) in proximity to an inner surface of walls of the pressure cylinder before the pressure medium re-enters into the furnace chamber.

Thus, in accordance with the first aspect, the pressing arrangement includes an outer cooling loop in which the pressure medium after having exiting the furnace chamber can be guided before eventually being returned to the furnace chamber. During its passage through the outer cooling loop, the pressure medium is cooled by dissipating heat or thermal energy to components of the pressing arrangement such as walls of pressure medium guiding passages and walls of the pressure vessel. In accordance with the first aspect, the pressure medium exiting the furnace chamber is firstly guided in a part of the outer cooling loop formed between at least portions of the housing and the heat insulating portion, respectively, towards the end closure of the pressure vessel's pressure cylinder. The pressure medium may hence pass between an outer surface of the heat insulating portion and an inner surface of the housing that is at least partly enclosing the heat insulating portion, whereby the pressure medium may be cooled by passing in proximity to an inner surface of the housing, which may be cooler than the heat insulating portion. Subsequently, at least a part of the pressure medium, or even all (or substantially all) of the pressure medium, passes through a heat absorbing element, whereby the pressure medium can be further cooled. After the pressure medium has exited heat absorbing element, the pressure medium is guided in proximity to an inner surface of walls of the pressure vessel, whereby the pressure medium can be further cooled, before the pressure medium re-enters into the furnace chamber.

In the light of the foregoing, by means of the at least one first pressure medium guiding passage, the at least one second pressure medium guiding passage in the outer cooling loop, and the heat absorbing element, a relatively quick cooling of any article, which for example may be placed in the furnace chamber, to a required or desired temperature for example during a cooling phase of a treatment cycle, may be achieved. Further, by appropriately configuring for example the heat absorbing element with respect to its heat absorbing capacity or capability, it may be possible to achieve a relatively high rate of cooling of the article, e.g., during a cooling phase of a treatment cycle.

The heat absorbing element, which in alternative could be referred to as a heat sink unit, or a heat exchanger unit, may be arranged entirely within the pressure vessel. The heat absorbing element may be a 'passive' element in the sense that the heat absorbing element may not be provided with any conduits, passages, channels or the like for conveying cooling medium to or from the heat absorbing element. The heat absorbing element may have no connection with the exterior of the pressure vessel. In particular, the heat absorbing element may have no fluid communication with the exterior of the pressure vessel.

The pressure medium used in the pressure vessel or pressing arrangement may for example comprise or be constituted by a liquid or gaseous medium which may have a relatively low chemical affinity in relation to the article(s) to be treated in the pressing arrangement. The pressure medium may for example comprise a gas, for example an inert gas such as Argon gas, or a liquid, for example an oil.

The at least one second pressure medium guiding passage may be arranged along walls of the pressure vessel, for example along walls of the pressure cylinder.

The walls of the pressure cylinder, which walls have an inner surface which the pressure medium having exited the heat absorbing element is guided in proximity to (in the at least one second pressure medium guiding passage) before the pressure medium re-enters into the furnace chamber, may comprise outer walls of the pressure cylinder. The outer walls of the pressure cylinder may for example comprise lateral or circumferential walls of the pressure cylinder. On the outside surface of the outer walls of the pressure cylinder (or on the envelope surface of the pressure cylinder), channels, conduits and/or tubes, etc., may be provided, in which a flow of coolant may be provided for cooling of the outer walls of the pressure cylinder.

On the outside surface of the outer walls of the pressure cylinder, and possibly on any channels, conduits and/or tubes, etc. for coolant, pre-stressing means may be provided. The pre-stressing means may for example be provided in the form of wires (e.g., made of steel) wound in a plurality of turns so as to form one or more bands, and preferably in several layers, around the outside surface of the outer walls of the pressure cylinder and possibly also any channels, conduits and/or tubes, etc. for coolant that may be provided thereon. The pre-stressing means may be arranged for exerting radial compressive forces on the pressure cylinder.

The amount of thermal energy that may be transferred from the pressure medium, which is guided in proximity to the inner surface of walls of the pressure cylinder, to the walls of the pressure cylinder, may depend on at least one of the following: the speed of the pressure medium during its passage in proximity to the inner surface of the walls of the pressure cylinder, the amount of pressure medium having (direct) contact with the inner surface of the walls of the pressure cylinder during the passage of the pressure medium in proximity to the inner surface of the walls of the pressure cylinder, and the relative temperature difference between the pressure medium and the walls of the pressure cylinder. The walls of the pressure cylinder may be the outer walls of the pressure cylinder.

In the context of the present application, by an outer cooling loop it is meant a cooling loop that is separate from a cooling loop within the furnace chamber, e.g., a convection loop within the furnace chamber.

The heat absorbing element may for example be arranged such that the first side of the heat absorbing element is opposite to the second side of the heat absorbing element. Thus, the first and second sides of the heat absorbing element may be two opposite sides of the heat absorbing element.

The at least one inlet of the heat absorbing element may for example comprise at least one opening. The at least one outlet of the heat absorbing element may comprise at least one opening.

In accordance with one or more embodiments of the present invention, the heat absorbing element may comprise a plurality of inlets. At least a portion of the first side of the heat absorbing element may comprise a plurality of perforations or openings which are distributed over the at least a portion of the first side of the heat absorbing element. The plurality of perforations or openings which are distributed over the at least a portion of the first side of the heat absorbing element may constitute the plurality of inlets of the heat absorbing element. The pressure medium which has exited the furnace chamber and which is guided in a part of the outer cooling loop formed between at least portions of the housing and the heat insulating portion, respectively, towards the end closure of the pressure vessel's pressure cylinder, may, due to the flow resistance of the pressure medium, become evenly or substantially evenly distributed over the at least a portion of the first side of the heat absorbing element which comprises the plurality of perforations or openings. Thereby, it may be facilitated or ensured that a relatively large amount of the pressure medium which has exited the furnace chamber enters into the interior of the heat absorbing element.

The heat absorbing element may be configured or arranged in different ways in order to tailor or customize its heat absorbing capacity or capability with respect to different requirements or desires. Thereby, it may be possible to achieve a relatively high rate of cooling of the article, e.g., during a cooling phase of a treatment cycle.

In accordance with one or more embodiments of the present invention, the (interior of the) heat absorbing element may for example exhibit a multi-channel structure, or a honeycomb structure (i.e., a structure having a geometry similar to a honeycomb). The heat absorbing element may for example comprise a plurality of pressure medium guiding channels, each of which may be arranged to guide the pressure medium having entered into the heat absorbing element within the interior of the heat absorbing element towards or to the at least one outlet of the heat absorbing element. The pressure medium guiding channels of the heat absorbing element may for example be comprised in, or be constituted by, a honeycomb structure.

Each pressure medium guiding channel may be generally extending along an axis between the first side of the heat absorbing element and the second side of the heat absorbing element.

At least one of the pressure medium guiding channels of the heat absorbing element may for example have a square, circular, or oval cross section as seen in a direction along the respective pressure medium guiding channel. Pressure medium guiding channels having a square, or substantially square, cross section as seen in a direction along the respective pressure medium guiding channels may be particularly advantageous with regards to providing a relatively low flow resistance for the pressure medium while the pressure medium is conveyed through the pressure medium guiding channels. Thereby, a relatively rapid cooling of any article, which for example may be placed in the furnace chamber, to a required or desired temperature for example during a cooling phase of a treatment cycle, may be facilitated, while at the same time keeping the required duration of the cooling phase relatively short. It is to be understood that at least one of the pressure medium guiding channels of the heat absorbing element may have a cross section as seen in a direction along the respective pressure medium guiding channel other than a square, circular, or oval one, which shapes hence are exemplifying. For example, triangular or quadrilateral shapes, or any other polygonal shape, may be contemplated in accordance with one or more embodiments of the present invention.

At least a portion or part of the heat absorbing element may be made of metal, or another material having a relatively high thermal conductivity.

For example, the (interior of the) heat absorbing element may include one or more heat accumulating elements, such as, for example, a plurality of spheres made of metal or another material having a relatively high thermal conductivity.

In alternative or in addition, the (interior of the) heat absorbing element may include a porous structure of a material having a relatively high thermal conductivity. For example, the (interior of the) heat absorbing element could possibly include a metal foam, e.g., a so called open foam, having interconnected pores.

Possibly, the heat absorbing element may comprise a plurality of outlets. At least a portion of the second side of the heat absorbing element may comprise a plurality of perforations or openings distributed over the at least a portion of the second side of the heat absorbing element. The plurality of perforations or openings of the second side of the heat absorbing element may constitute the plurality of outlets of the heat absorbing element.

The at least one second pressure medium guiding passage may further be arranged along the end closure of the pressure vessel's pressure cylinder.

The at least one second pressure medium guiding passage may be arranged to guide the pressure medium having exited the heat absorbing element (via the at least one second opening) further in proximity to the end closure before the pressure medium re-enters into the furnace chamber. While being guided in proximity to the end closure, heat, or thermal energy, may be transferred from the pressure medium to the end closure, via which the heat, or thermal energy, may subsequently be dissipated from the pressure vessel. Thus, by arranging the at least one second pressure medium guiding passage to guide the pressure medium having exited the heat absorbing element further in proximity to the end closure before the pressure medium re-enters into the furnace chamber, the cooling of the pressure medium may be increased. Thereby, a relatively quick cooling of any article, which for example may be placed in the furnace chamber, to a required or desired temperature for example during a cooling phase of a treatment cycle, may be facilitated, while at the same time keeping the required duration of the cooling phase relatively short.

The amount of thermal energy that may be transferred from the pressure medium, which is guided in proximity to the end closure, to the end closure, may depend on at least one of the following: the speed of the pressure medium during its passage in proximity to the end closure, the amount of pressure medium having (direct) contact with the end closure during the passage of the pressure medium in proximity to the end closure, and the relative temperature difference between the pressure medium and the end closure.

The heat absorbing element may be at least partly enclosed by the housing, for example such that there is a space between the second side of the heat absorbing element and a portion of the housing, into which space the pressure medium having exited the heat absorbing element may enter (or enters). The pressure medium may be guided to the at least one second pressure medium guiding passage via at least one opening in the above-mentioned portion of the housing. As mentioned in the foregoing, the at least one second pressure medium guiding passage may further be arranged along the end closure, and the at least one second pressure medium guiding passage may be arranged to guide the pressure medium having exited the heat absorbing element further in proximity to the end closure before the pressure medium re-enters into the furnace chamber. The pressure medium may be guided to the at least one second pressure medium guiding passage—in proximity to the end closure—via at least one opening in the above-mentioned portion of the housing.

The at least one opening in the above-mentioned portion of the housing may for example be a single opening, possibly centered in relation to a longitudinal axis of the pressure vessel, directed towards the end closure. Thereby, a relatively high velocity flow of pressure medium having exited the heat absorbing element towards an inner surface of the end closure may be achieved. In turn, this may facilitate or allow for a relatively large transfer of heat, or thermal energy, from the pressure medium to the end closure, via which the heat, or thermal energy, may subsequently be dissipated from the pressure vessel, thereby increasing the cooling of the pressure medium. Thereby, a relatively quick cooling of any article, which for example may be placed in the furnace chamber, to a required or desired temperature for example during a cooling phase of a treatment cycle, may be facilitated, while at the same time keeping the required duration of the cooling phase relatively short.

The heat absorbing element may be mechanically connected to the end closure. The heat absorbing element may be mechanically connected to the end closure in order to (further) facilitate for a relatively large transfer of heat, or thermal energy, from the pressure medium to the end closure. With the heat absorbing element being mechanically connected to the end closure, the heat absorbing element may not merely be thermally coupled or connected to the end closure via pressure medium flowing between the heat absorbing element and the end closure. At least a portion of any heat or thermal energy that is absorbed by the heat absorbing element from pressure medium being conveyed through the heat absorbing element may, by way of the mechanical connection between the heat absorbing element and the end closure, be transferred from the heat absorbing element to the end closure. The heat or thermal energy that is transferred from the heat absorbing element to the end closure may subsequently be dissipated from the pressure vessel via the end closure. Thus, by way of the heat absorbing element being mechanically connected to the end closure, the cooling of the pressure medium may be increased. Thereby, a relatively quick cooling of any article, which for example may be placed in the furnace chamber, to a required or desired temperature for example during a cooling phase of a treatment cycle, may be facilitated, while at the same time keeping the required duration of the cooling phase relatively short.

The heat absorbing element may be mechanically connected to the end closure for example by means of a part or portion of the heat absorbing element being in mechanical contact with the end closure. In alternative or in addition, the heat absorbing element may be mechanically connected to the end closure for example by means of one or more separate thermally conducting elements connected with the heat absorbing element and the end closure.

The heat absorbing element may be arranged within the pressure vessel in different ways. The heat absorbing element may for example be secured, or fixedly connected, for example to a portion of the housing. In alternative or in addition, the heat absorbing element may be supported by at least one supporting structure, which may be coupled to at least one of the heat insulating portion or the housing.

The end closure may for example comprise or be constituted by a top end closure.

The pressure vessel may further include a bottom end closure. The pressure vessel may hence include a top end closure and a bottom end closure, or—more generally—a first end closure and a second end closure. The furnace chamber may for example be arranged so that pressure medium can enter the furnace chamber from, and exit the furnace chamber into, a space between the furnace chamber and the bottom (or second) end closure. The pressure vessel, or the pressure cylinder of the pressure vessel, may for example be arranged such that an inner surface of the top (or first) end closure and an inner surface of the bottom (or second) end closure are directed towards, or substantially towards, each other.

Each of any one of the above-mentioned end closures may be arranged such that it can be opened and closed, for example according to any manner known in the art.

Further objects and advantages of the present invention are described in the following by means of exemplifying embodiments. It is noted that the present invention relates to all possible combinations of features recited in the claims. Further features of, and advantages with, the present invention will become apparent when studying the appended claims and the description herein. Those skilled in the art realize that different features of the present invention can be combined to create embodiments other than those described herein.

BRIEF DESCRIPTION OF THE DRAWINGS

Exemplifying embodiments of the present invention will be described below with reference to the accompanying drawings.

All the figures are schematic, not necessarily to scale, and generally only show parts which are necessary in order to elucidate embodiments of the present invention, wherein other parts may be omitted or merely suggested.

DETAILED DESCRIPTION

The present invention will now be described hereinafter with reference to the accompanying drawings, in which exemplifying embodiments of the present invention are shown. The present invention may, however, be embodied in many different forms and should not be construed as limited to the embodiments of the present invention set forth herein; rather, these embodiments are provided by way of example so that this disclosure will convey the scope of the present invention to those skilled in the art.

Figure 1:
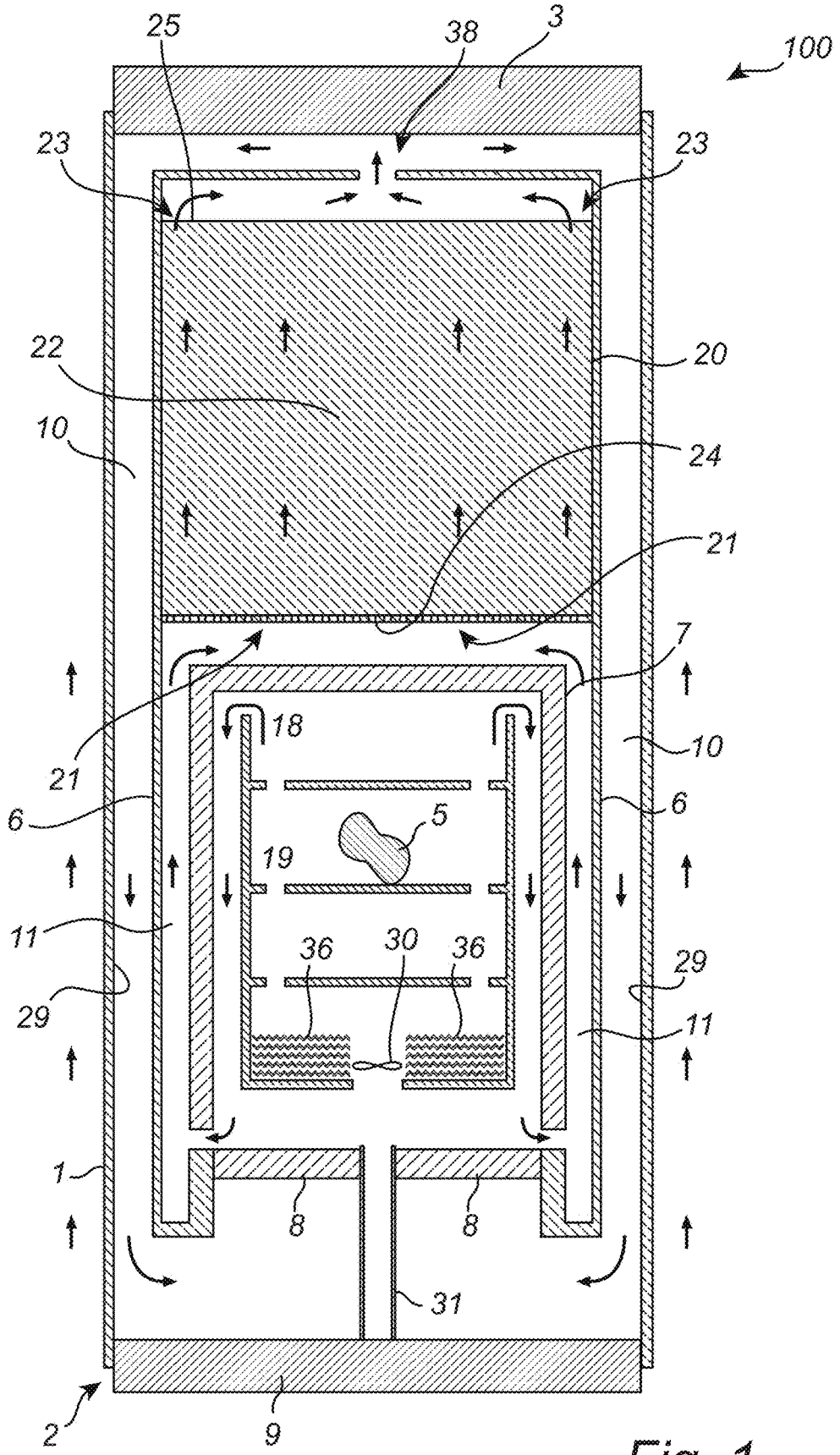
FIG. 1 is a schematic, in part sectional, side view of a pressing arrangement according to an embodiment of the present invention.

FIG. 1 is a schematic, in part sectional, side view of a pressing arrangement 100 according to an embodiment of the present invention. The pressing arrangement 100 is intended to be used for pressing of at least one article, schematically indicated at reference numeral 5. The pressing arrangement 100 comprises a pressure vessel 2. Although not shown in FIG. 1, the pressure vessel 2 may comprise elements, means, modules, etc., such as one or more ports, inlets, outlets, valves, etc., for supplying and discharging pressure medium to and from the pressure vessel 2.

The pressure vessel 2 comprises a pressure cylinder 1 and a top end closure 3 and a bottom end closure 9. The pressure vessel 2 comprises a furnace chamber 18. The furnace chamber 18 comprises a furnace, or heater or heating elements, for heating of the pressure medium in the pressure vessel for example during a pressing phase of a treatment cycle. The furnace is schematically indicated in FIG. 1 by the reference numerals 36. In accordance with the embodiment of the present invention illustrated in FIG. 1, the furnace 36 may be arranged at a lower portion of the furnace chamber 18. In alternative or in addition, the furnace 36 could be arranged in proximity to the inner side, or lateral, surfaces of the furnace chamber 18. It is to be understood that different configurations and arrangements of the furnace 36 in relation to, e.g., within, the furnace chamber 18 are possible. Any implementation of the furnace 36 with regard to arrangement thereof in relation to, e.g., within, the furnace chamber 18 may be used in any one of the embodiments of the present invention described herein. In the context of the present application, the term "furnace" refers to the elements or means for providing heating, while the term "furnace chamber" refers to the area or region in which the furnace and possibly the load compartment and any article are located. As illustrated in FIG. 1, the furnace chamber 18 may not occupy the whole inner space of the pressure vessel 2, but may leave an intermediate space 10 of the interior of the pressure vessel 2 around the furnace chamber 18. The intermediate space 10 forms a pressure medium guiding passage 10. During operation of the pressing arrangement 100, the temperature in the intermediate space 10 may be lower than the temperature in the furnace chamber 18, but the intermediate space 10 and the furnace chamber 18 may be at equal, or substantially equal, pressure. The outer surface of the outer walls of the pressure vessel 2 may be provided with channels, conduits or tubes, etc. (not shown), which channels, conduits or tubes for example may be arranged so as to be in connection with the outer surface of the outer wall of the pressure vessel 2 and may be arranged to run parallel to an axial direction of the pressure vessel 2. A coolant for cooling of the walls of the pressure vessel 2 may be provided in the channels, conduits or tubes, whereby the walls of the pressure vessel 2 may be cooled in order to protect the walls from detrimental heat building up during operation of the pressure vessel 2. The coolant in the channels, conduits or tubes may for example comprise water, but another or other types of coolants are possible. An exemplifying flow of coolant in channels, conduits or tubes provided on the outer surface of the outer walls of the pressure vessel 2 is indicated in FIG. 1 by the arrows on the outside of the pressure vessel 2.

Even though it is not explicitly indicated in any of the figures, the pressure vessel 2 may be arranged such that it can be opened and closed, such that any article 5 within the pressure vessel 2 may be inserted or removed. An arrangement of the pressure vessel 2 such that it can be opened and closed may be realized in a number of different manners, as known in the art. Although not explicitly indicated in FIG. 1, one or both of the top end closure 3 and the bottom end closure 9 may be arranged so that it can be opened and closed.

The furnace chamber 18 is enclosed by a heat insulated casing 6, 7, 8, and is arranged so that pressure medium can enter and exit the furnace chamber 18. In accordance with the embodiment of the present invention illustrated in FIG. 1, the heat insulated casing 6, 7, 8 comprises a heat insulating portion 7, a housing 6 which is partly enclosing the heat insulating portion 7, and a bottom insulating portion 8. Although the heat insulated casing is collectively referred to by the reference numerals 6, 7, 8, not all of the elements of the heat insulated casing 6, 7, 8 may be arranged so as to be heat insulated or heat insulating. For example, the housing 6 may not be arranged so as to be heat insulated or heat insulating.

The pressing arrangement 100 comprises a heat absorbing element 20. The heat absorbing element 20 is arranged within the pressure vessel 2 and is configured to absorb heat from the pressure medium. At least a portion or part of the heat absorbing element 20 may for example be made of metal, or another material having a relatively high thermal conductivity. The heat absorbing element 20 will be further described in the following.

A pressure medium guiding passage 11 is formed between the heat insulating portion 7 and the housing 6. As illustrated in FIG. 1, the pressure medium guiding passages 10 and 11 are in fluid communication with the furnace chamber 18 and are arranged to form at least a part of an outer cooling loop within the pressure vessel 2. The flow of pressure medium during a cooling phase of a treatment cycle is illustrated by the arrows within the pressure vessel 2 shown in FIG. 1. A part of the outer cooling loop comprises the pressure medium guiding passage 11 formed between portions of the housing 6 and the heat insulating portion 7, respectively. The pressure medium guiding passage 11 is arranged to guide the pressure medium after having exited the furnace chamber 18 towards the top end closure 3 to a space between the top end closure 3 and the furnace chamber 18 in which the heat absorbing element 20 is arranged. The heat absorbing element 20 may be suspended or arranged within the space between the top end closure 3 and the furnace chamber 18 for example by means of one or more supporting structures (not shown in FIG. 1), which supporting structure(s) for example may be attached to the housing 6 and/or to the heat insulating portion 7. As illustrated in FIG. 1, the pressure medium may exit the load compartment 19 and subsequently be guided in a pressure medium guiding passage between the walls of the load compartment 19 and the heat insulating portion 7, after which the pressure medium may enter into the pressure medium guiding passage 11 by way of openings between the heat insulating portion 7 and the housing 6. The openings between the heat insulating portion 7 and the housing 6 may possibly be provided with valves or any other type of adjustable throttle or pressure medium flow restriction means.

The heat absorbing element 20 comprises a plurality of inlets 21 which permit the pressure medium that has exited the furnace chamber 18 to enter into an interior 22 of the heat absorbing element 20. The heat absorbing element 20 is configured so as to permit pressure medium to be guided through the heat absorbing element 20 towards a plurality of outlets 23 of the heat absorbing element 20. The plurality of outlets 23 permit the pressure medium to exit the heat absorbing element 20. The inlets 21 are arranged on a first side 24 of the heat absorbing element 20 and the outlets 23 are arranged on a second side 25 of the heat absorbing element 20. It is to be understood that it is not necessary to have a plurality of inlets 21 and a plurality of outlets 23. Possibly, there could be only one inlet 21 on the first side 24 of the heat absorbing element 20, and there could possibly be only one outlet 23 on the second side 25 of the heat absorbing element 20.

The second side 25 of the heat absorbing element 20 is facing in a direction towards an inner surface of the top end closure 3, for example such as illustrated in FIG. 1. As further illustrated in FIG. 1, the heat absorbing element 20 may be arranged such that the first side 24 of the heat absorbing element 20 is opposite to the second side 25 of the heat absorbing element 20.

Another part of the outer cooling loop comprises a pressure medium guiding passage defined by a space in part defined by the inner surface of the top end closure 3 (e.g., below the top end closure 3), and the pressure medium guiding passage 10. The pressure medium guiding passage defined by the space in part defined by the inner surface of the top end closure 3 and the pressure medium guiding passage 10 are arranged to guide the pressure medium having exited the heat absorbing element 20 in proximity to the top end closure 3 and in proximity to an inner surface 29 of walls of the pressure vessel 2 (e.g., the walls of the pressure cylinder 1, respectively, as illustrated in FIG. 1) before the pressure medium re-enters into the furnace chamber 18. Thus, in the other part of the outer cooling loop, the pressure medium is guided in proximity to the inner surface of the top end closure 3 and the inner surface 29 of walls of the pressure cylinder 1. The amount of thermal energy which may be transferred from the pressure medium during its passage in proximity to inner surfaces of the top end closure 3 and the inner surface 29 of walls of the pressure cylinder 1 may depend on at least one of the following: the speed of the pressure medium, the amount of pressure medium having (direct) contact with the inner surface of the top end closure 3 and with the inner surface 29 of walls of the pressure cylinder 1, the relative temperature difference between the pressure medium and the inner surface of the top end closure 3 and the inner surface 29 of walls of the pressure cylinder 1, the thickness of the top end closure 3 and the thickness of the pressure cylinder 1, and the temperature of any flow of coolant in channels, conduits or tubes provided on the outer surface of walls of the pressure cylinder 1 (indicated in FIG. 1 by the arrows on the outside of the pressure cylinder 1).

The pressure medium that is guided in the pressure medium guiding passage 10 back towards the furnace chamber 18 enters a space between the furnace chamber 18—or the bottom insulating portion 8—and the bottom end closure 9. The furnace chamber 18 may be arranged so that pressure medium can enter the furnace chamber 18 from, and exit the furnace chamber 18 into, the space between the furnace chamber 18 and the bottom end closure 9. For example, and in accordance with the embodiment of the present invention illustrated in FIG. 1, the furnace chamber 18 may be provided with an opening in the bottom insulating portion 8 permitting pressure medium flow into or out of the furnace chamber 18. As illustrated in FIG. 1, the pressing arrangement 100 may comprise a fan 30 or the like for circulation of pressure medium within the furnace chamber 18. In accordance with the embodiment of the present invention illustrated in FIG. 1, the fan 30 may for example be arranged at the above-mentioned opening in the bottom insulating portion 8 which permits pressure medium flow into or out of the furnace chamber 18.

As illustrated in FIG. 1, there may be provided a pressure medium conduit 31 (e.g., comprising a transport pipe) which may extend from the space between the bottom insulating portion 8 and the bottom end closure 9 and through the bottom insulating portion 8, so that pressure medium from the pressure medium guiding passage 10 which enters into the space between the bottom insulating portion 8 and the bottom end closure 9 can be guided via the pressure medium conduit 31 into the furnace chamber 18. The pressure medium conduit 31 may be provided with one or more openings (not shown in FIG. 1), which possibly may include one or more adjustable throttles such as valves, permitting flow of pressure medium into the pressure medium conduit 31. In alternative or in addition, an end of the pressure medium conduit 31 may terminate at a distance from the inner surface of the bottom end closure 9 and may have an inlet located in the space between the bottom insulating portion 8 and the bottom end closure 9, thereby permitting flow of pressure medium into the pressure medium conduit 31. The pressing arrangement 100 may comprise at least one flow generator, for example in the form of one or more fan, pumps, ejectors or the like. The at least one flow generator may be arranged in the pressure vessel 2 so as to transport pressure medium, which enters into the space between the bottom insulating portion 8 and the bottom end closure 9 after having been guided in the pressure medium guiding passage 10, towards and into the furnace chamber 18 for example via the pressure medium conduit 31 illustrated in FIG. 1. The at least one flow generator is not shown in FIG. 1.

In accordance with the embodiment of the present invention illustrated in FIG. 1, the heat absorbing element 20 is at least partly enclosed by the housing 6 such that there is a space between the second side 25 of the heat absorbing element 20 and a portion of the housing 6 into which space the pressure medium having exited the heat absorbing element 20 may enter. The pressure medium exiting the heat absorbing element 20 into this space is guided via (at least) an opening 38 in the portion of the housing 6 to the pressure medium guiding passage defined by the space in part defined by the inner surface of the top end closure 3 and the pressure medium guiding passage 10.

Figure 2:
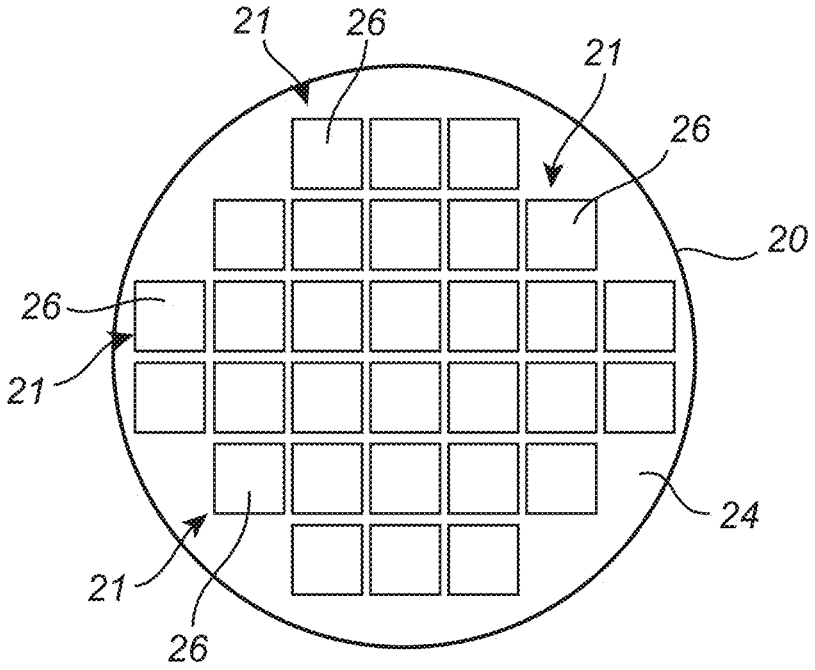
FIG. 2 is a view of a heat absorbing element in accordance with an embodiment of the present invention as seen from above the first side of the heat absorbing element where a plurality of inlets in the form of openings are arranged.
Figure 3:
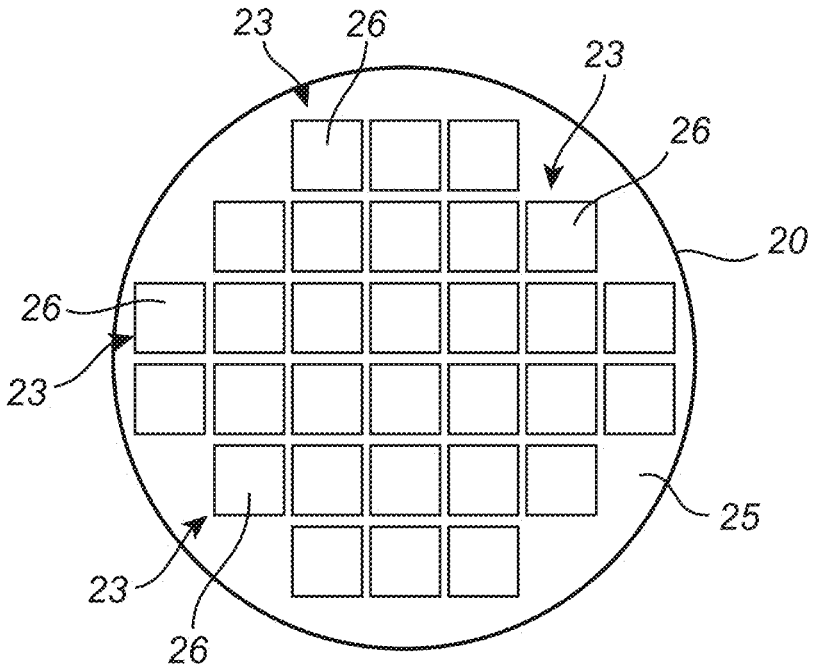
FIG. 3 is a view of the heat absorbing element illustrated in FIG. 2 as seen from above the second side of the heat absorbing element where a plurality of outlets in the form of openings are arranged.

FIG. 2 is a view of a heat absorbing element 20 in accordance with an embodiment of the present invention as seen from above the first side 24 of the heat absorbing element 20 where a plurality of inlets 21 in the form of openings 21 are arranged. FIG. 3 is a view of the heat absorbing element 20 illustrated in FIG. 2 as seen from above the second side 25 of the heat absorbing element 20 where a plurality of outlets 23 in the form of openings 23 are arranged. The heat absorbing element 20 comprises a plurality of pressure medium guiding channels 26 arranged to guide the pressure medium having entered into the heat absorbing element 20 within the interior thereof towards or to the at least one outlet of the heat absorbing element 20. Each of the pressure medium guiding channels 26 may for example have an inlet 21 and a corresponding outlet 23, but this is not required. For example, one or some pressure medium guiding channels 26 may each have an inlet manifold and an outlet 26.

The arrangement or configuration of the pressure medium guiding channels 26 within the heat absorbing element 20 may be realized or implemented in different manners. For example, the pressure medium guiding channels 26 of the heat absorbing element 20 could be comprised in or be constituted by a honeycomb structure.

In accordance with the embodiment of the present invention illustrated in FIGS. 2 and 3, the pressure medium guiding channels 26 of the heat absorbing element 20 each have a square cross section as seen in a direction along the respective pressure medium guiding channel 26. However, it is to be understood that this is according to an example, and that one or more of the pressure medium guiding channels 26 could have a cross-section as seen in a direction along the respective pressure medium guiding channel other than a square shape, such as, for example, a circular, triangular, or a quadrilateral shape, or any other polygonal shape.

It is to be understood that a configuration of the heat absorbing element 20 with a plurality of pressure medium guiding channels 26 as illustrated in FIGS. 2 and 3 is exemplifying and that other configurations are possible. For example, the interior 22 of the heat absorbing element 20 could include one or more heat accumulating elements, such as, for example, a plurality of spheres made of metal or another material having a relatively high thermal conductivity (not shown in the figures). In alternative or in addition, the interior 22 of the heat absorbing element 20 could include a porous structure (not shown in the figures) of a material having a relatively high thermal conductivity. For example, the interior 22 of the heat absorbing element 20 could possibly include a metal foam, e.g., a so called open foam, having interconnected pores.

Figure 4:
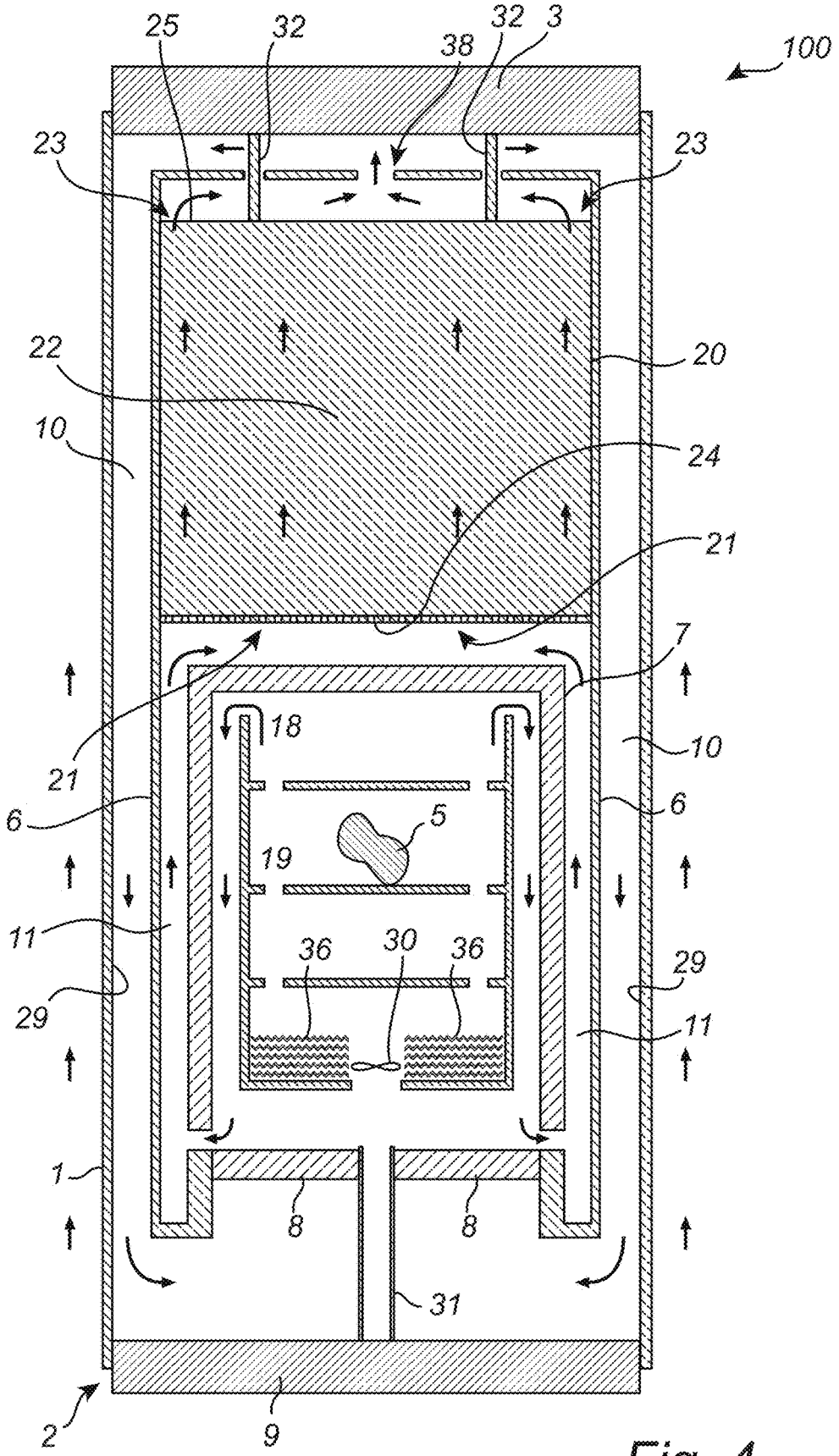
FIG. 4 is a schematic, in part sectional, side view of a pressing arrangement according to an embodiment of the present invention.

FIG. 4 is a schematic, in part sectional, side view of a pressing arrangement 100 according to an embodiment of the present invention. The pressing arrangement 100 illustrated in FIG. 4 is similar to the pressing arrangement 100 illustrated in FIG. 1, and the same reference numerals indicate the same or similar components, having the same or similar function. The pressing arrangement 100 illustrated in FIG. 4 differs from the pressing arrangement 100 illustrated in FIG. 1 in that the pressing arrangement 100 illustrated in FIG. 4 comprises connecting elements 32 which are arranged to mechanically connect the heat absorbing element 20 to the top end closure 3. The connecting elements 32 may be made of a thermally conducting material, e.g., a metal or a metallic material. In alternative or in addition, the heat absorbing element 20 could be mechanically connected to the top end closure 3 by means of a part or portion of the heat absorbing element 20 being in mechanical contact with the top end closure 3 (not shown in FIG. 4).

In conclusion, a pressing arrangement is disclosed. The pressing arrangement comprises a pressure vessel and a furnace chamber arranged within the pressure vessel. The furnace chamber is at least partly enclosed by a heat insulated casing and arranged so that pressure medium can enter and exit the furnace chamber. The pressing arrangement comprises a plurality of pressure medium guiding passages in fluid communication with the furnace chamber and arranged to form an outer cooling loop within the pressure vessel. The pressing arrangement comprises a heat absorbing element which is arranged within the pressure vessel and which is configured to absorb heat from pressure medium having exited the furnace chamber.

While the present invention has been illustrated in the appended drawings and the foregoing description, such illustration is to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. In the appended claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A pressing arrangement comprising:

a pressure vessel comprising a pressure cylinder and a first end closure and a second end closure;

a furnace chamber arranged within the pressure vessel, the furnace chamber being at least partly enclosed by a heat insulated casing and arranged so that pressure medium is configured to enter and exit the furnace chamber;

a plurality of pressure medium guiding passages in fluid communication with the furnace chamber and arranged to form an outer cooling loop within the pressure vessel; and a heat absorbing element arranged within the pressure vessel and configured to absorb heat from the pressure medium;

wherein the heat insulated casing comprises a heat insulating portion and a housing at least partly enclosing the heat insulating portion, and wherein a part of the outer cooling loop comprises at least one first pressure medium guiding passage formed between at least a portion of the housing and at least a portion of the heat insulating portion, and arranged to guide the pressure medium after having exited the furnace chamber towards the first end closure to a space between the first end closure and the furnace chamber in which the heat absorbing element is arranged, the heat absorbing element comprising a plurality of inlets permitting the pressure medium having exited the furnace chamber to enter into an interior of the heat absorbing element, the heat absorbing element being configured so as to permit pressure medium to be guided through the heat absorbing element towards at least one outlet of the heat absorbing element, the at least one outlet permitting the pressure medium to exit the heat absorbing element, wherein the plurality of inlets are arranged on a first side of the heat absorbing element and the at least one outlet is arranged on a second side of the heat absorbing element, wherein at least a portion of the first side of the heat absorbing element comprises a plurality of perforations or openings distributed over the at least a portion of the first side of the heat absorbing element, the plurality of perforations or openings constituting the plurality of inlets of the heat absorbing element, wherein the plurality of inlets of the heat absorbing element permit all of the pressure medium guided in the at least one first pressure medium guiding passage to enter into the interior of the heat absorbing element, wherein the second side of the heat absorbing element is facing in a direction towards an inner surface of the first end closure, and wherein each of the plurality of inlets of the heat absorbing element is arranged above the heat insulating portion in a vertical direction and in a flow direction of the pressure medium in the at least one first pressure medium guiding passage towards the first end closure; and wherein another part of the outer cooling loop comprises at least one second pressure medium guiding passage arranged to guide the pressure medium having exited the heat absorbing element in proximity to an inner surface of walls of the pressure cylinder before the pressure medium re-enters into the furnace chamber.

2. A pressing arrangement according to claim 1, wherein the heat absorbing element is arranged such that the first side of the heat absorbing element is opposite to the second side of the heat absorbing element.

3. A pressing arrangement according to claim 2, wherein the at least one outlet of the heat absorbing element comprises at least one opening.

4. A pressing arrangement according to claim 1, wherein the at least one outlet of the heat absorbing element comprises at least one opening.

5. A pressing arrangement according to claim 1, wherein the heat absorbing element comprises a plurality of pressure medium guiding channels arranged to guide the pressure medium having entered into the heat absorbing element within the interior of the heat absorbing element towards or to the at least one outlet of the heat absorbing element.

6. A pressing arrangement according to claim 5, wherein the plurality of pressure medium guiding channels of the heat absorbing element are comprised in or constituted by a honeycomb structure.

7. A pressing arrangement according to claim 6, wherein at least one of the plurality of pressure medium guiding channels of the heat absorbing element has a square, circular, or oval cross section as seen in a direction along the respective pressure medium guiding channel.

8. A pressing arrangement according to claim 5, wherein at least one of the plurality of pressure medium guiding channels of the heat absorbing element has a square, circular, or oval cross section as seen in a direction along the respective pressure medium guiding channel.

9. A pressing arrangement according to claim 1, wherein the at least one second pressure medium guiding passage is further arranged to guide the pressure medium having exited the heat absorbing element further in proximity to the first end closure before the pressure medium re-enters into the furnace chamber.

10. A pressing arrangement according to claim 1, wherein the heat absorbing element is at least partly enclosed by the housing such that there is a space between the second side of the heat absorbing element and a portion of the housing, wherein the pressure medium enters the space after exiting the heat absorbing element, wherein the pressure medium is guided to the at least one second pressure medium guiding passage via at least one opening in said portion of the housing.

11. A pressing arrangement according to claim 1, wherein the heat absorbing element is mechanically connected to the first end closure.

12. A pressing arrangement according to claim 1, wherein said first end closure comprises a top end closure, and wherein said second end closure comprises a bottom end closure, wherein the furnace chamber is arranged so that pressure medium is configured to enter the furnace chamber from, and exit the furnace chamber into, a space between the furnace chamber and the bottom end closure.

13. A pressing arrangement comprising:

a pressure vessel comprising a pressure cylinder and a first end closure and a second end closure;

a furnace chamber arranged within the pressure vessel, the furnace chamber being at least partly enclosed by a heat insulated casing and arranged so that pressure medium is configured to enter and exit the furnace chamber;

a plurality of pressure medium guiding passages in fluid communication with the furnace chamber and arranged to form an outer cooling loop within the pressure vessel; and a passive heat exchanger unit arranged within the pressure vessel and configured to absorb heat from the pressure medium, wherein the passive heat exchanger unit is entirely arranged within the pressure vessel and arranged such that the passive heat exchanger unit does not require any exchange of cooling medium with a source during operation of the pressing arrangement;

wherein the heat insulated casing comprises a heat insulated layer and a housing at least partly enclosing the heat insulated layer, and wherein a part of the outer cooling loop comprises at least one first pressure medium guiding passage formed between at least a portion of the housing and at least a portion of the heat insulated layer, and arranged to guide the pressure medium after having exited the furnace chamber towards the first end closure to a space between the first end closure and the furnace chamber in which the passive heat exchanger unit is arranged, the passive heat exchanger unit comprising a plurality of inlets permitting the pressure medium having exited the furnace chamber to enter into an interior of the passive heat exchanger unit, the passive heat exchanger unit being configured so as to permit pressure medium to be guided through the passive heat exchanger unit towards at least one outlet of the passive heat exchanger unit, the at least one outlet permitting the pressure medium to exit the passive heat exchanger unit, wherein the plurality of inlets are arranged on a first side of the passive heat exchanger unit and the at least one outlet is arranged on a second side of the passive heat exchanger unit, wherein at least a portion of the first side of the passive heat exchanger unit comprises a plurality of perforations or openings distributed over the at least a portion of the first side of the passive heat exchanger unit, the plurality of perforations or openings constituting the plurality of inlets of the passive heat exchanger unit, wherein the plurality of inlets of the passive heat exchanger unit permit all of the pressure medium guided in the at least one first pressure medium guiding passage to enter into the interior of the passive heat exchanger unit, wherein the second side of the passive heat exchanger unit is facing in a direction towards an inner surface of the first end closure, and wherein each of the plurality of inlets of the passive heat exchanger unit is arranged above the heat insulating layer in a vertical direction and in a flow direction of the pressure medium in the at least one first pressure medium guiding passage towards the first end closure;

wherein another part of the outer cooling loop comprises at least one second pressure medium guiding passage arranged to guide the pressure medium having exited the passive heat exchanger unit in proximity to an inner surface of walls of the pressure cylinder before the pressure medium re-enters into the furnace chamber.

* * * * *